US006019543A

United States Patent [19]

Junker

[11] Patent Number: 6,019,543

[45] Date of Patent: Feb. 1, 2000

[54] FOOT FOR A TRAFFIC BEACON USED AS A ROUTING DEVICE FOR ROAD TRAFFIC

[76] Inventor: Wilhelm Junker, Reutlingerstrasse 14, 71522 Backnang, Germany

[21] Appl. No.: 09/051,594

[22] PCT Filed: Nov. 20, 1995

[86] PCT No.: PCT/EP95/04563

§ 371 Date: Jun. 22, 1998

§ 102(e) Date: Jun. 22, 1998

[87] PCT Pub. No.: WO97/15728

PCT Pub. Date: May 1, 1997

[30] Foreign Application Priority Data

Oct. 20, 1995 [DE] Germany ..... 295 16 613 U

[51] Int. Cl.[7] ..... B01F 9/00; A47G 1/17; A01K 97/10; G01P 5/00; G09F 7/02

[52] U.S. Cl. ..... 404/10; 404/9; 248/205.3; 248/539; 116/63 R; 40/612

[58] Field of Search ..... 404/6, 9, 10; 116/63 R; 256/13.1; 40/608, 612; 248/205.3, 316.6, 539

[56] References Cited

U.S. PATENT DOCUMENTS

| | | | |
|---|---|---|---|
| 3,091,997 | 6/1963 | Byrd | 404/10 |
| 3,380,428 | 4/1968 | Abrams | 116/63 R |
| 3,564,984 | 2/1971 | Alexander | 116/63 R |
| 3,572,223 | 3/1971 | Vierregger | 116/63 R |
| 3,758,191 | 9/1973 | Hedgewick | 404/9 |
| 3,858,997 | 1/1975 | Boone | 404/10 |
| 3,866,873 | 2/1975 | Bohli | 248/205 A |
| 3,902,818 | 9/1975 | Boone | 404/10 |
| 4,515,499 | 5/1985 | Furiate . | |
| 4,717,281 | 1/1988 | Shepherd et al. | 404/16 |
| 5,031,828 | 7/1991 | Fischer | 232/39 |
| 5,168,827 | 12/1992 | Junker | 116/63 P |
| 5,468,093 | 11/1995 | Voigt | 404/6 |
| 5,503,496 | 4/1996 | Voigt | 404/10 |

FOREIGN PATENT DOCUMENTS

| | | |
|---|---|---|
| 2641557 | 7/1990 | France . |
| 29503161 | 6/1995 | Germany . |

*Primary Examiner*—Thomas B. Will
*Assistant Examiner*—Gary S. Hartmann
*Attorney, Agent, or Firm*—Jordan and Hamburg LLP

[57] ABSTRACT

A foot for a traffic beacon, serving as routing device for road traffic, is proposed. At its lower end, the traffic beacon is coupled detachably with the foot. The traffic beacon, at least in its lower part, consists of a soft, elastic material and, at its lower edge, has a laterally protruding flange, which engages appropriately shaped recesses in the foot. These recesses are formed by clamping jaws, which can be bolted to a foot plate and, in each case, have a horizontal, inwardly protruding cross member. Nubs, protruding at the underside of the clamping jaws, press into the soft elastic material of the flange when the screws are tightened.

9 Claims, 1 Drawing Sheet

FOOT FOR A TRAFFIC BEACON USED AS A ROUTING DEVICE FOR ROAD TRAFFIC

BACKGROUND OF THE INVENTION

The invention relates to a foot for a routing device for road traffic, in which a traffic beacon is detachably coupled to the foot. Such traffic beacons are used particularly at building sites, at which the flow of traffic is to be changed, in order to mark the altered traffic streams. In particular, this occurs where traffic streams flowing in opposite directions are to be partitioned from one another without separation by broad strips of roadway. The traffic beacons are either coupled individually to their own foot or fastened to a base plate composed of individual sections. The traffic beacons are constructed so that they cannot be damaged by the unintentional, but not always avoidable, collision with a vehicle. This can be achieved owing to the fact that it is possible to bend over and even drive over the traffic beacons. The traffic beacons then straighten up once again because of their inherent elasticity.

A known device of the above type is described, for example, in the German utility patent DE 29 503 161. For this device, the traffic beacon is coupled to the foot by a the flange, disposed at the lower edge of the traffic beacon, which can be pushed sideways into appropriately shaped recesses in the foot. In the pushed-in position, the traffic beacons are held only by positive locking between mutually engaging parts. As a consequence, the parts can become detached from one another in operation, that is, for instance, by collision with vehicles. This is undesirable even when the traffic beacon moves only a short distance and not completely out of the recess in the foot.

It is therefore an object of the invention to provide secure fastening of the traffic beacon in the foot.

SUMMARY OF THE INVENTION

This objective is accomplished by providing a foot which includes a foot plate and clamping jaws mounted thereto. The clamping jaws include cross members having nubs which press into a flange of a traffic beacon received in a space between the cross members and the foot plate when the cross members are urged towards the foot plate.

Owing to the fact that the nubs at the clamping jaws always press into the material of the flange, disposed at the lower end of the traffic beacon, any unintentional loosening of the connection between the traffic beacon and the foot is avoided.

Further advantageous developments of the foot are also provided.

In the following, the invention is explained by means of an example shown in the drawing, in which like reference numerals designate the same elements.

DETAILED DESCRIPTION OF THE INVENTION

Figure 1:
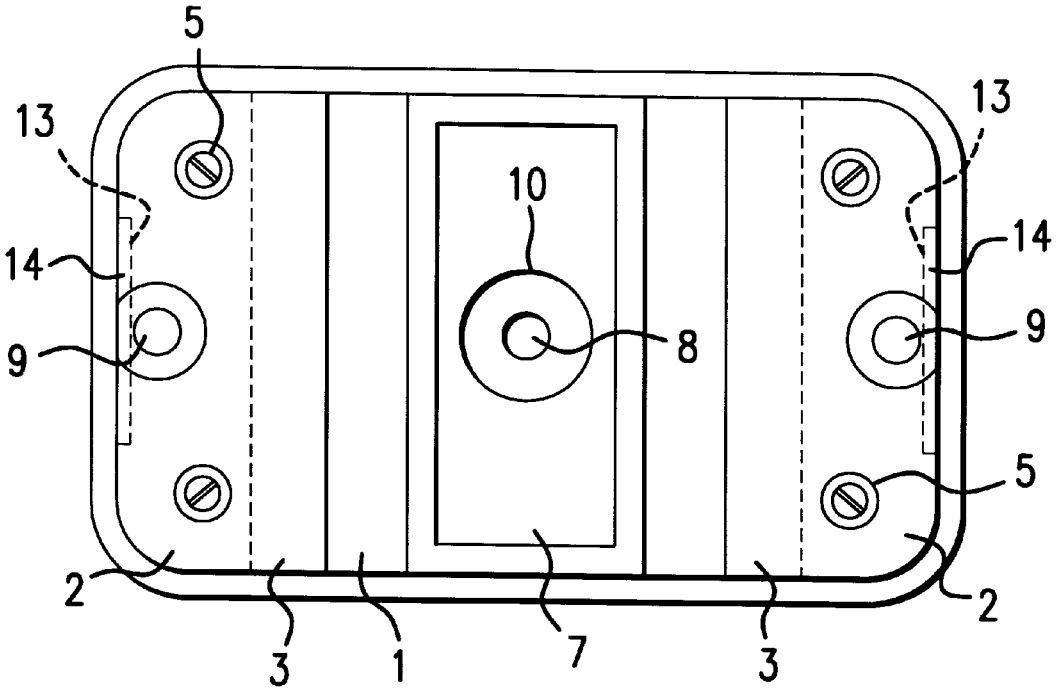
FIG. 1 is a a plan view of the foot

The foot consists of a foot plate 1, which is intended to lie on the substrate, and of clamping jaws 2, which are detachably connected with the foot plate 1. The foot plate 1 and the clamping jaws 2 are connected by means of screws 5, which are inserted through screw holes in the clamping jaws 2. At the underside of the foot plate 1, there are depressions for accommodating nuts 6. The shape of the depressions corresponds to that of the nuts 6, so that the latter are prevented from rotating. The depth of the depressions is such that the nuts 6 do not protrude below the underside of the foot plate 1.

Each clamping jaw 2 has an inwardly directed cross member 3, the distance of which from the upper side of the foot plate 1 corresponds to the height of the flange of the traffic beacon. At the underside of each cross member 3, there are nubs 4, which are pressed into the soft elastic material of the flange when the screws 5 are tightened, so as to ensure that the traffic beacon is fastened securely in the foot.

Between the cross members 3, but at a distance from these, there is an elevation 7, which is fastened to the foot plate 1 and has an essentially rectangular shape in plan view as well as in side view. The dimensions of the elevation 7 in the longitudinal direction are selected so that the elevation 7, with positive connection, engages the traffic beacon, which is open at the bottom.

In the center of the elevation 7, there is a continuous hole 8, which is disposed at the foot of a depression 10. An adhesive, for connecting the foot to the substrate, can be introduced through this hole.

In accordance with a different or additional possibility for such a connection, a hole 9 for the passage of a fastening screw is provided in each clamping jaw 2 and at the appropriate place in the foot plate 1.

The connection between the foot and the traffic beacon is brought about in the following manner. With, with screws 5 loosened, the traffic beacon is pushed sideways into the foot. When the desired position is reached, the screws 5 are tightened, as a result of which the desired secure connection is established. It is also possible to place the traffic beacon from above onto the foot. However, this requires that the clamping jaws 2 be dismantled previously.

When the foot plate 1 is glued to the substrate, this gluing must take place before the traffic beacon is inserted into the foot. On the other hand, when fastening screws are used, the unit, consisting of foot and traffic beacon, is completed and connected as a whole with the substrate.

Particularly for adjusting, each clamping jaw 2 has a lower recess 11, which is engaged by a rib 12 disposed on the upper side of the foot plate 1.

Figure 2:
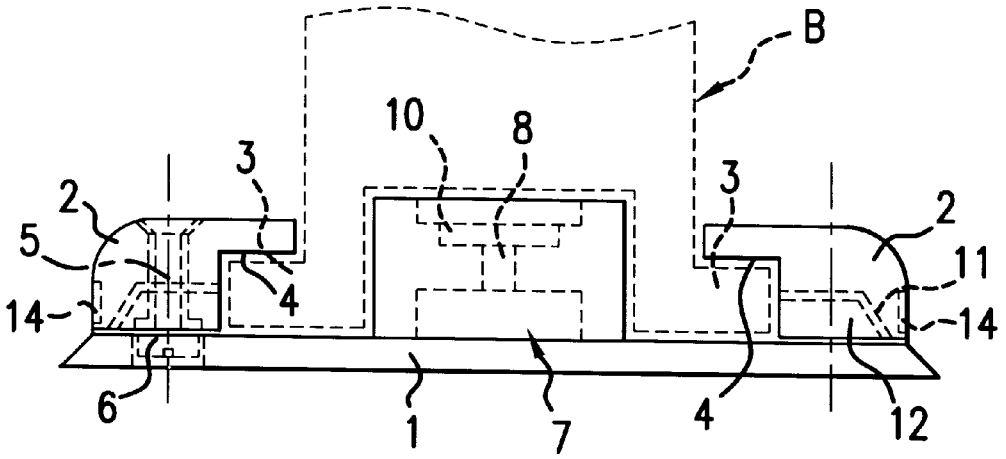
FIG. 2 is a a side view of the foot.

In FIG. 2, the traffic beacon B, which is inserted into the foot, is represented by broken lines.

At the outside of each clamping jaw 2, a reflector 14 is inserted into a recess 13. This reflector 14 comprises, for example, colored glass spheres, which reflect the light of vehicles passing by and thus cause the driver and also the pedestrian to be more attentive, especially when it is dark.

When the foot is used permanently, the clamping jaws also serve to prevent theft.

I claim:

1. A foot for a traffic beacon serving as a routing device for road traffic, the traffic beacon being detachably coupled at a lower end thereof with the foot, the traffic beacon being of a type consisting at least in lower part thereof of an elastic material and having a laterally protruding flange formed at a lower edge of the traffic beacon, the foot comprising:

a foot plate; and clamping jaws each including a horizontal, inwardly protruding cross member which is receivable upon the flange of the traffic beacon, each said cross member including nubs which protrude from an underside thereof, the clamping jaws being detachably mounted to the foot plate in a manner permitting mounted movement of the cross members from a first position in which the traffic beacon is laterally installed onto the foot by slidable reception of the flange in the space between the cross members and an opposed surface of the foot plate, to a second position in which the cross members are urged against the flange sufficiently to cause the nubs to press into the elastic material of the flange.

2. The foot according to claim 1, wherein the traffic beacon includes an opening at a bottom thereof, the foot plate including an elevation formed in region between the cross members and spaced apart therefrom for engaging an interior structure of the traffic beacon peripherally defining the opening.

3. The foot according to claim 1 or 2, further comprising:

nuts which are inserted into correspondingly shaped depressions formed at an underside of the foot plate and which thereby prevent rotation of the nuts; and screws for threadably engaging the nuts, each being inserted through a screw hole in the clamping jaws formed in a position outward of the cross members thereof.

4. The foot according to claim 1 or 2, wherein each of the clamping jaws includes a hole, the foot plate including respective holes each aligned with a corresponding one of the holes in the clamping jaws, each of the holes in the clamping jaws and the respective holes in the foot plate permitting reception therethrough of a screw to fasten the foot to the substrate.

5. The foot according to claim 1 or 2, wherein the nubs are disposed in two rows on each said cross member.

6. The foot according to claim 1 or 2, wherein each said clamping jaw has a lower recess which is engaged by a rib disposed at an upper side of the foot plate.

7. The foot according to claim 1 or 2, wherein each said clamping jaw includes at least one reflector disposed at an outside thereof.

8. A foot for a traffic beacon serving as a routing device for road traffic when placed upon a substrate, the traffic beacon being detachably coupled at a lower end thereof with the foot, the traffic beacon consisting at least in its lower part of an elastic material and having a laterally protruding flange formed at a lower edge of the traffic beacon, the foot comprising:

a foot plate;

clamping jaws detachably connected to the foot plate, said clamping jaws each including a horizontal, inwardly protruding cross member which is receivable upon the flange of the traffic beacon, the cross member including nubs which protrude from an underside of the cross member and, when the clamping jaws are urged in a direction towards the foot plate, press into the elastic material of the flange; and a hole disposed in a central position of the elevation for introducing an adhesive for fastening the foot to the substrate.

9. The foot according to claim 8, wherein the hole is disposed at a base of a depression.

* * * * *